US010928044B2

(12) United States Patent
Huang et al.

(10) Patent No.: US 10,928,044 B2
(45) Date of Patent: Feb. 23, 2021

(54) DOWNLIGHT APPARATUS

(71) Applicant: XIAMEN ECO LIGHTING CO. LTD., Xiamen (CN)

(72) Inventors: Zhenkun Huang, Xiamen (CN); Shouqiang Hou, Xiamen (CN); Xiaoliang Wen, Xiamen (CN); Yongzhe Dong, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/816,232

(22) Filed: Mar. 11, 2020

(65) Prior Publication Data

US 2020/0340651 A1 Oct. 29, 2020

(30) Foreign Application Priority Data

Apr. 26, 2019 (CN) ..... 201920589812.2
Apr. 26, 2019 (CN) ..... 201920589878.1

(51) Int. Cl.

| | |
|---|---|
| ***F21S 8/00*** | (2006.01) |
| ***F21V 21/14*** | (2006.01) |
| ***F21S 8/02*** | (2006.01) |
| ***F21V 23/00*** | (2015.01) |
| ***F21V 25/04*** | (2006.01) |
| ***F21V 29/70*** | (2015.01) |
| ***F21V 23/04*** | (2006.01) |
| *F21Y 115/10* | (2016.01) |

(52) U.S. Cl.

CPC ..... *F21V 21/14* (2013.01); *F21S 8/026* (2013.01); *F21V 23/006* (2013.01); *F21V 23/04* (2013.01); *F21V 25/04* (2013.01); *F21V 29/70* (2015.01); *F21Y 2115/10* (2016.08)

(58) Field of Classification Search

CPC ..... F21V 21/14; F21V 23/04; F21V 25/04; F21V 23/006; F21V 29/70; F21S 8/026; F21S 8/024; F21Y 2115/10

See application file for complete search history.

(56) References Cited

U.S. PATENT DOCUMENTS

| | | | | |
|---|---|---|---|---|
| 2008/0106907 | A1* | 5/2008 | Trott | F21V 29/713 362/368 |
| 2011/0080733 | A1* | 4/2011 | Wang | F21V 21/04 362/253 |
| 2011/0110106 | A1* | 5/2011 | Dupuy | F21S 8/026 362/368 |
| 2019/0101266 | A1* | 4/2019 | Shah | F21V 17/18 |

* cited by examiner

*Primary Examiner* — Y M. Quach Lee
(74) *Attorney, Agent, or Firm* — Chun-Ming Shih; Lanway IPR Services

(57) ABSTRACT

A downlight apparatus includes a light source module, a cup housing, and a rotation structure. The cup housing has a surface rim and cup body. The surface rim defines a light opening. The surface rim covers an installation hole of an installation cavity. The multiple LED modules are disposed in the container space for emitting light out of the downlight apparatus from the light opening. The rotation structure selectively defines a first exterior diameter and a second exterior diameter. The first exterior diameter being larger than the second exterior diameter and an installation diameter of the installation hole. The second exterior diameter is smaller than the installation diameter.

18 Claims, 15 Drawing Sheets

DOWNLIGHT APPARATUS

FIELD

The present invention is related to a downlight apparatus and more particularly related to a downlight apparatus with a convenient installation structure.

BACKGROUND

For many years the lighting of interiors of vehicles, aircraft, buildings, signage, and watercraft, and more recently the lighting of exteriors of vehicles, and signage have used the cold cathode lamp; more commonly known as the fluorescent lamp or a fluorescent system. The fluorescent lamp however has limitations on its capabilities and usages. The fluorescent lamp has disadvantages to the consumer. The disadvantages of the fluorescent lamp are the short life, easily broken, low durability, high costs of replacement, high costs of specialty lights, limited color selection, electromagnetic interference which may be harmful to other electronic equipment. The manufacturing of fluorescent lamps and debris from replaced lamps have a high environmental risk, as the chemicals inside of a fluorescent lamp are toxic. Also, the flicker effect of dying or improperly installed fluorescent lamps may be extremely harmful to individuals with certain medical conditions. The constant inconsistency of fluorescent lighting colors is often a complaint of consumers who have to replace lamps on a regular basis. A fluorescent system cannot be used effectively in extreme low or high ambient temperatures.

Light emitting diode (LED) lighting technology is rapidly developing to replace traditional incandescent and fluorescent lighting. LED tube lamps are mercury free in comparison with fluorescent tube lamps that need to be filled with inert gas and mercury. Thus, it is not surprising that LED tube lamps are becoming a highly desired illumination option among different available lighting systems used in homes and workplaces, which used to be dominated by traditional lighting options such as compact fluorescent light bulbs and fluorescent tube lights. Benefits of LED lights include improved durability and longevity and far less energy consumption.

A light-emitting diode (LED) is a semiconductor light source that emits light when current flows through it. Electrons in the semiconductor recombine with electron holes, releasing energy in the form of photons. This effect is called electroluminescence. The color of the light (corresponding to the energy of the photons) is determined by the energy required for electrons to cross the band gap of the semiconductor. White light is obtained by using multiple semiconductors or a layer of light-emitting phosphor on the semiconductor device.

Appearing as practical electronic components in 1962, the earliest LEDs emitted low-intensity infrared light. Infrared LEDs are used in remote-control circuits, such as those used with a wide variety of consumer electronics. The first visible-light LEDs were of low intensity and limited to red. Modern LEDs are available across the visible, ultraviolet, and infrared wavelengths, with high light output.

Early LEDs were often used as indicator lamps, replacing small incandescent bulbs, and in seven-segment displays. Recent developments have produced white-light LEDs suitable for room lighting. LEDs have led to new displays and sensors, while their high switching rates are useful in advanced communications technology.

LEDs have many advantages over incandescent light sources, including lower energy consumption, longer lifetime, improved physical robustness, smaller size, and faster switching. Light-emitting diodes are used in applications as diverse as aviation lighting, automotive headlamps, advertising, general lighting, traffic signals, camera flashes, lighted wallpaper and medical devices.

Unlike a laser, the color of light emitted from an LED is neither coherent nor monochromatic, but the spectrum is narrow with respect to human vision, and functionally monochromatic.

The energy efficiency of electric lighting has increased radically since the first demonstration of arc lamps and the incandescent light bulb of the 19th century. Modern electric light sources come in a profusion of types and sizes adapted to many applications. Most modern electric lighting is powered by centrally generated electric power, but lighting may also be powered by mobile or standby electric generators or battery systems. Battery-powered light is often reserved for when and where stationary lights fail, often in the form of flashlights, electric lanterns, and in vehicles.

Although lighting devices are widely used, there are still lots of opportunity and benefit to improve the lighting devices to provide more convenient, low cost, reliable and beautiful lighting devices for enhancing human life.

SUMMARY OF INVENTION

In an embodiment, a downlight apparatus includes a light source module, a cup housing, and a rotation structure.

The light source module has multiple LED modules. The cup housing has a surface rim and cup body. The surface rim defines a light opening. The light opening is located at an opening horizontal plane.

The surface rim covers an installation hole of an installation cavity. The multiple LED modules are disposed in the container space for emitting light out of the downlight apparatus from the light opening.

The rotation structure selectively defines a first exterior diameter and a second exterior diameter. The first exterior diameter being larger than the second exterior diameter and an installation diameter of the installation hole. The second exterior diameter is smaller than the installation diameter.

The rotation structure is connected to the cup housing. When the downlight apparatus is to be installed to the installation cavity, the rotation structure is adjusted to the second exterior diameter to put the downlight apparatus in the installation cavity from the installation hole.

In some embodiments, the first exterior diameter corresponds a first horizontal plane, and the second exterior diameter corresponds a second horizontal plane. The first horizontal plane and the second horizontal plane are substantially parallel to the opening horizontal plane. For example, the opening horizontal plane is the opening via which to install a downlight apparatus commonly seen in various places. In some areas, there is an installation behind the installation hole. An installation box, in some areas, may be provided in addition to provide a simple empty installation cavity.

The downlight apparatus, when to be installed, is adjusted by rotating the rotation structure so as to change the rotation structure with ends spanning from the first exterior diameter to the second exterior diameter so as to be inserted into the installation cavity via the installation hole. After the downlight apparatus is installed, the rotation structure recovers to the status with the first exterior diameter which is larger than the diameter of the installation hole so as to keep the downlight apparatus in the installation cavity.

In some embodiments, the rotation structure includes multiple rotating arms. Arm ends of the multiple rotating arms defines the first exterior diameter and the second exterior diameter, depending on whether the rotation structure is rotated.

In some embodiments, the rotation structure has two rotating arms disposed in opposite sides of the downlight apparatus.

In some embodiments, the rotation structure has at least three rotating arms symmetrically arranged. Three rotating arms usually brings a better stability than just two opposite rotating arms. Four or more than four rotating arms may be used according to different design needs.

In some embodiments, the rotation arm has a rotation shaft fixed to the cup housing for the rotation arm to rotate for changing the rotation structure from the first exterior diameter to the second exterior diameter.

In some embodiments, there is a receiver groove for containing at least a portion of the rotating arm. In some embodiments, each rotating arm may have a corresponding receiver groove, when the rotating arm is rotated with respect to the cup housing to decrease its spanning area, the rotation arm may be completely or partially stored in the associated receiver groove.

In some embodiments, the rotation structure may also include elastic units for the rotating arms respectively for providing elastic forces to recover the rotation structure from the second exterior diameter to the first exterior diameter. Such elastic unit may be an elastic clip, a spring or various other structure which provide elastic force to recover the rotation structure to an original shape while no external force is applied thereon.

In some embodiments, the rotating arm has a curved end portion. A concave of the curved end portion may be arranged to face to the installation hole to keep the rotating arm stably staying in the installation cavity. Alternatively, a concave of the curved end may be designed opposite to the direction facing to the installation hole so that the rotating arm is easily to be detached from the installation hole while a pulling force is applied on the downlight apparatus, e.g. on the surface rim exposed outside the ceiling.

In some embodiments, the rotating arm has an end portion attached with a friction pad for increasing friction between the rotating arm and the installation cavity.

In some embodiments, there is a connecting structure for brining other rotating arms to rotate when one rotating arm is rotated.

In some embodiments, when a pulling force over a threshold force is applied from the surface rim, the rotation structure is deformed and escape from the installation cavity.

In some embodiments, there is a safety switch connecting to a driver. The driver supplies a driving current to the light source module. When the rotation structure is modified from the first exterior diameter to the second exterior diameter, the safety switch is triggered to cut the driving current to the light source module.

For example, a toggle switch has protruding part adjacent to a rotation part of the rotating arm. When the rotating arm is rotated, the protruding part is pushed, pressed or deformed. Such status may be converted to an electronic signal sent to a driver module of the downlight apparatus. When the driver module receives such signal, acknowledging that the rotating arm is moving, which usually refers to a movement of the downlight apparatus, the driver module, if which is currently connected to an electrical source, turns off the electricity connection to prevent any electrical shock to the user to damages to the downlight apparatus.

In some embodiments, the rotating arm includes metal units engaging the installation cavity. For example, the rotating arm may be made of metal material, which is easy to conduct heat. Such design may enhance heat dissipation and increase overall rigidity. In addition, such design may provide fireproof effect, particularly when the ceiling is on fire, causing a heat that may deform a plastic structure.

When the fixing structure, i.e. the rotating arm, is made of metal material, the fixing structure keeps the downlight apparatus staying safely in the installation cavity, instead of falling down due to heat damage to its structure.

In some embodiments, the rotating arm is an elongated metal sheet.

In some embodiments, the rotating arm dissipates heat of the light source via a heat conducting structure.

In some embodiments, the rotation structure has an elastic force to recover from deformation.

In some embodiments, the downlight apparatus also has a driver box. The rotation structure is disposed between the driver box and the cup housing.

For example, the rotating arms have portions protruding from the lateral surface of the driver box and the cup housing.

In some embodiments, the driver box has a bottom cover, and the light source is mounted on the bottom cover.

In some embodiments, the bottom cover is connected to the cup housing together forming the container space.

In some embodiments, the driver box has a metal housing for carrying away heat the light source module and a driver circuit disposed in the metal housing.

DETAILED DESCRIPTION

Figure 12:
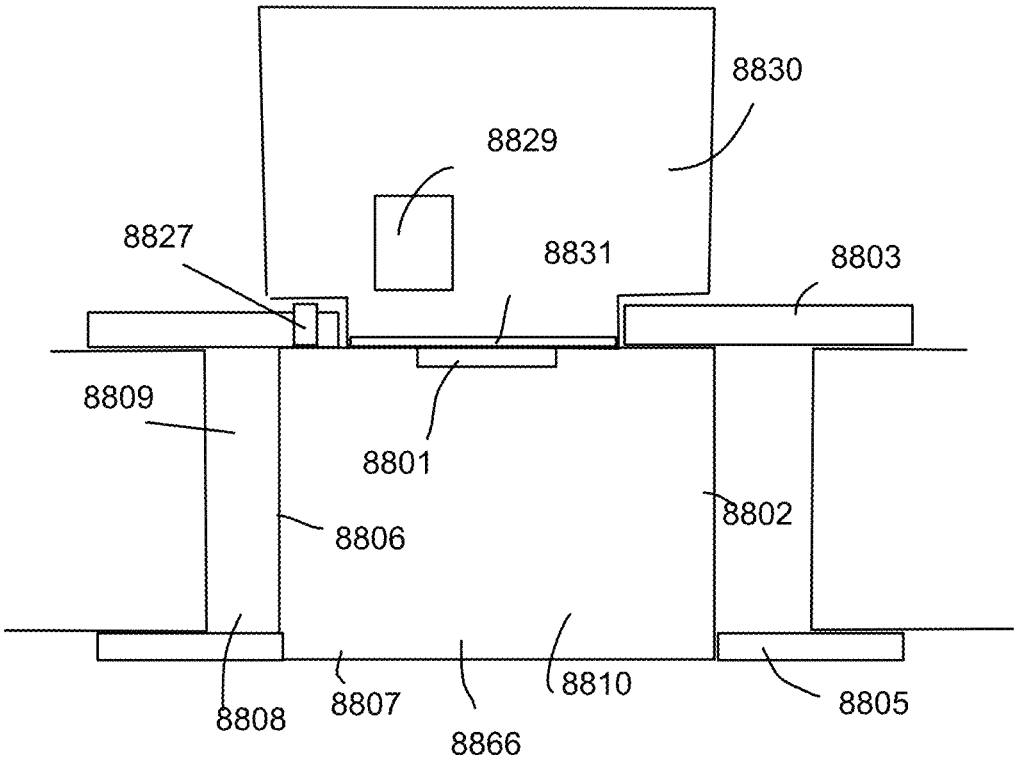
FIG. 12 shows a downlight apparatus example.

In FIG. 12, a downlight apparatus includes a light source module 8801, a cup housing 8802, and a rotation structure 8803.

The light source module 8801 has multiple LED modules. The cup housing 8802 has a surface rim 8805 and cup body 8806. The surface rim 8805 defines a light opening 8866. The light opening 8866 is located at an opening horizontal plane 8807.

The surface rim 8805 covers an installation hole 8808 of an installation cavity 8809. The multiple LED modules are disposed in the container space 8810 for emitting light out of the downlight apparatus from the light opening 8866.

Figure 13:
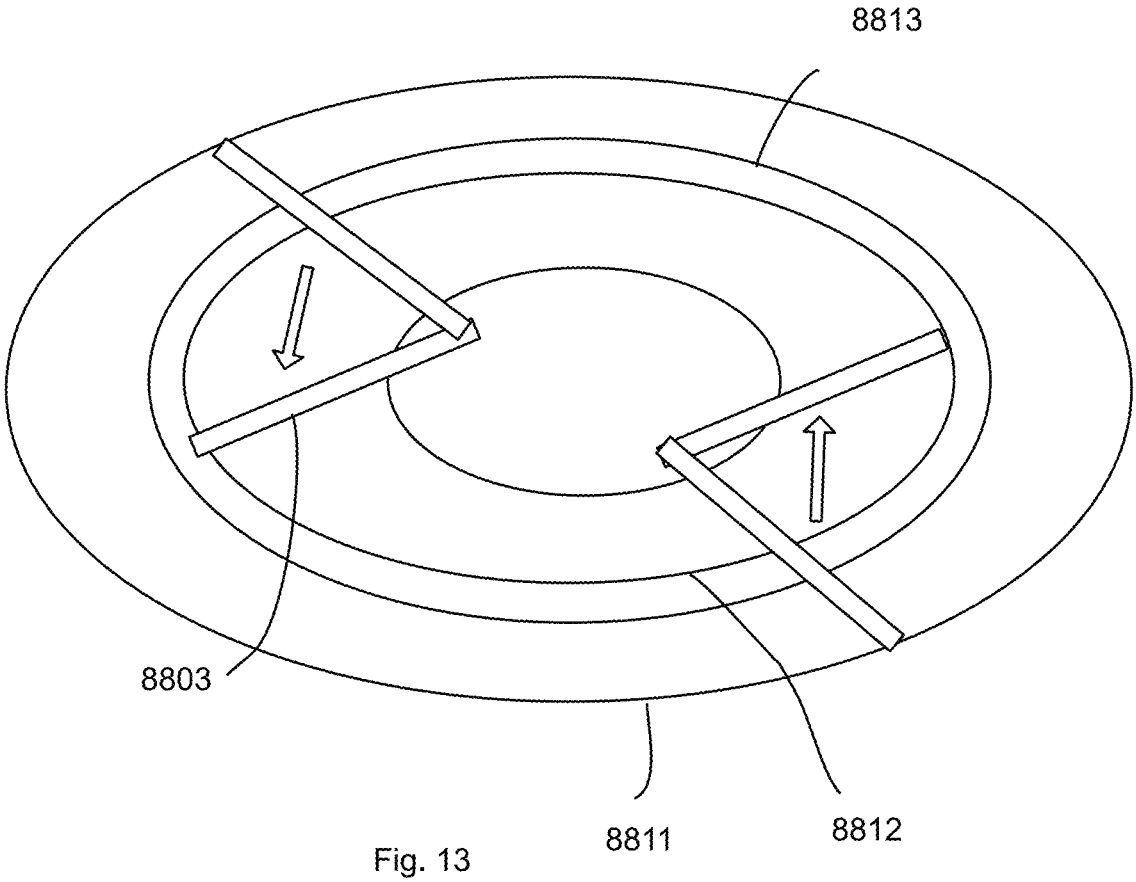
FIG. 13 shows spanning areas in different parallel planes.

Please refer to FIG. 13, the rotation structure 8803 selectively defines a first exterior diameter 8811 and a second exterior diameter 8812. The first exterior diameter 8811 is larger than the second exterior diameter 8812 and an installation diameter 8813 of the installation hole. The second exterior diameter 8812 is smaller than the installation diameter 8813.

Please refer back to FIG. 12, the rotation structure 8803 is connected to the cup housing 8802. When the downlight apparatus is to be installed to the installation cavity 8809, the rotation structure 8803 is adjusted to the second exterior diameter to put the downlight apparatus in the installation cavity 8809 from the installation hole 8808.

Figure 14:
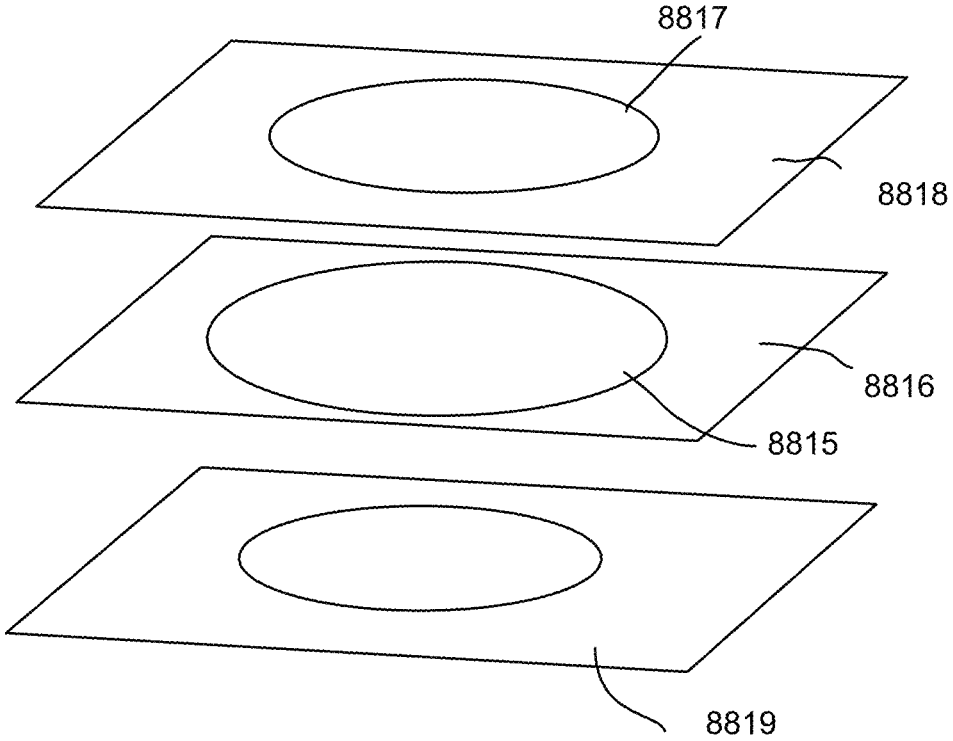
FIG. 14 shows a rotation structure operation for defining different diameters.

Please refer to FIG. 14, the first exterior diameter 8815 corresponds a first horizontal plane 8816, and the second exterior diameter 8817 corresponds a second horizontal plane 8818. The first horizontal plane 8816 and the second horizontal plane 8818 are substantially parallel to the opening horizontal plane 8819.

For example, the opening horizontal plane is the opening via which to install a downlight apparatus commonly seen in various places. In some areas, there is an installation behind the installation hole. An installation box, in some areas, may be provided in addition to provide a simple empty installation cavity.

The downlight apparatus, when to be installed, is adjusted by rotating the rotation structure so as to change the rotation structure with ends spanning from the first exterior diameter to the second exterior diameter so as to be inserted into the installation cavity via the installation hole. After the downlight apparatus is installed, the rotation structure recovers to the status with the first exterior diameter which is larger than the diameter of the installation hole so as to keep the downlight apparatus in the installation cavity.

Figure 15:
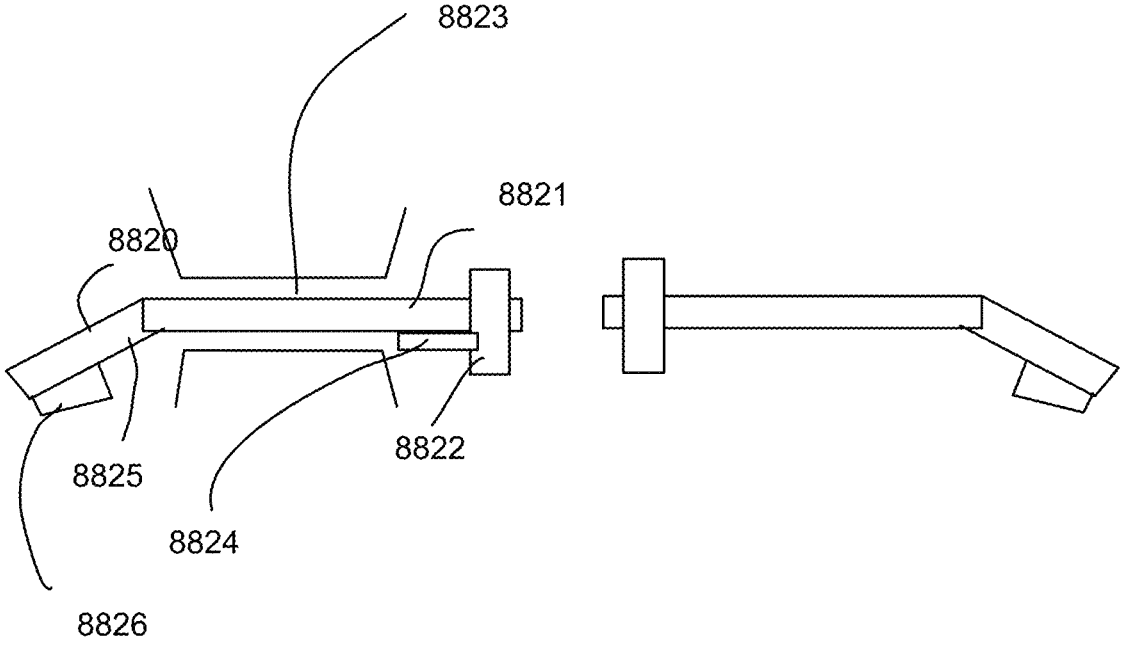
FIG. 15 shows an example of rotating arms.

Please refer to FIG. 15, the rotation structure includes multiple rotating arms. Arm ends 8820 of the multiple rotating arms 8821 defines the first exterior diameter and the second exterior diameter, depending on whether the rotation structure is rotated.

In FIG. 15, the rotation structure has two rotating arms 8821 disposed in opposite sides of the downlight apparatus.

In some embodiments, the rotation structure has at least three rotating arms symmetrically arranged. Three rotating arms usually brings a better stability than just two opposite rotating arms. Four or more than four rotating arms may be used according to different design needs.

In FIG. 15, the rotation arm 8821 has a rotation shaft 8822 fixed to the cup housing for the rotation arm to rotate for changing the rotation structure from the first exterior diameter to the second exterior diameter.

In FIG. 15, there is a receiver groove 8823 for containing at least a portion of the rotating arm. In some embodiments, each rotating arm may have a corresponding receiver groove, when the rotating arm is rotated with respect to the cup housing to decrease its spanning area, the rotation arm may be completely or partially stored in the associated receiver groove.

In FIG. 15, the rotation structure may also include elastic units 8824 for the rotating arms respectively for providing elastic forces to recover the rotation structure from the second exterior diameter to the first exterior diameter. Such elastic unit may be an elastic clip, a spring or various other structure which provide elastic force to recover the rotation structure to an original shape while no external force is applied thereon.

In FIG. 15, the rotating arm 8821 has a curved end portion 8825. A concave of the curved end portion 8825 may be arranged to face to the installation hole to keep the rotating arm stably staying in the installation cavity. Alternatively, a concave of the curved end may be designed opposite to the direction facing to the installation hole so that the rotating arm is easily to be detached from the installation hole while a pulling force is applied on the downlight apparatus, e.g. on the surface rim exposed outside the ceiling.

In FIG. 15, the rotating arm 8821 has an end portion attached with a friction pad 8826 for increasing friction between the rotating arm and the installation cavity.

In some embodiments, there is a connecting structure for brining other rotating arms to rotate when one rotating arm is rotated.

In some embodiments, when a pulling force over a threshold force is applied from the surface rim, the rotation structure is deformed and escape from the installation cavity.

Please refer back to FIG. 12, there is a safety switch 8827 connecting to a driver 8829. The driver 8829 supplies a driving current to the light source module 8801. When the rotation structure is modified from the first exterior diameter to the second exterior diameter, the safety switch 8827 is triggered to cut the driving current to the light source module.

For example, a toggle switch has protruding part adjacent to a rotation part of the rotating arm. When the rotating arm is rotated, the protruding part is pushed, pressed or deformed. Such status may be converted to an electronic signal sent to a driver module of the downlight apparatus. When the driver module receives such signal, acknowledging that the rotating arm is moving, which usually refers to a movement of the downlight apparatus, the driver module, if which is currently connected to an electrical source, turns off the electricity connection to prevent any electrical shock to the user to damages to the downlight apparatus.

In some embodiments, the rotating arm includes metal units engaging the installation cavity. For example, the rotating arm may be made of metal material, which is easy to conduct heat. Such design may enhance heat dissipation and increase overall rigidity. In addition, such design may provide fireproof effect, particularly when the ceiling is on fire, causing a heat that may deform a plastic structure.

When the fixing structure, i.e. the rotating arm, is made of metal material, the fixing structure keeps the downlight apparatus staying safely in the installation cavity, instead of falling down due to heat damage to its structure.

In some embodiments, the rotating arm is an elongated metal sheet.

In some embodiments, the rotating arm dissipates heat of the light source via a heat conducting structure.

In some embodiments, the rotation structure has an elastic force to recover from deformation.

In FIG. 12, the downlight apparatus also has a driver box 8830. The rotation structure is disposed between the driver box 8830 and the cup housing 8802.

For example, the rotating arms have portions protruding from the lateral surface of the driver box and the cup housing.

In FIG. 12, the driver box has a bottom cover 8831, and the light source is mounted on the bottom cover 8831.

In some embodiments, the bottom cover 8831 is connected to the cup housing together forming the container space.

In some embodiments, the driver box 8830*s* has a metal housing for carrying away heat the light source module and a driver circuit disposed in the metal housing.

Figure 1:
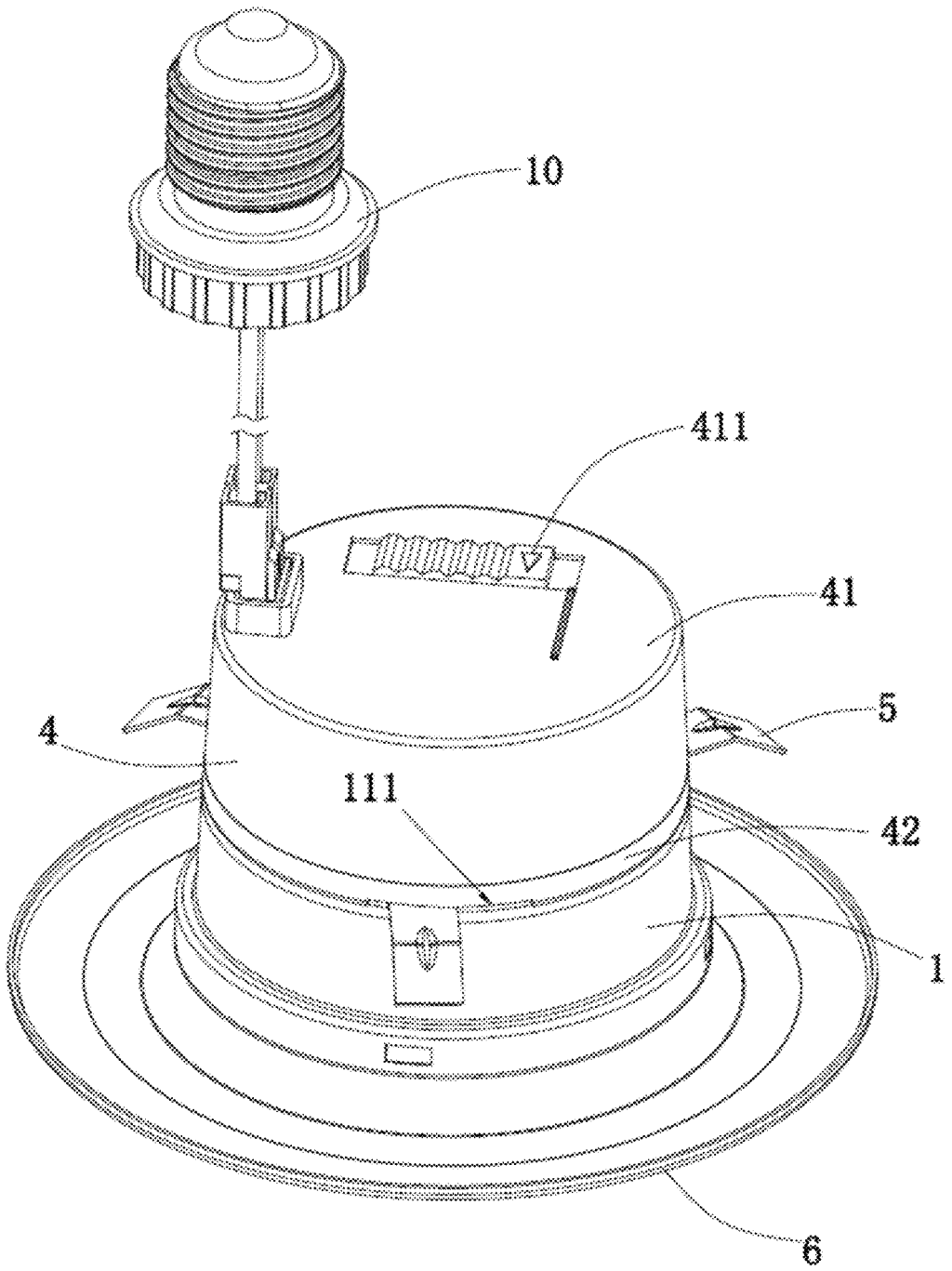
FIG. 1 is a downlight embodiment.
Figure 2:
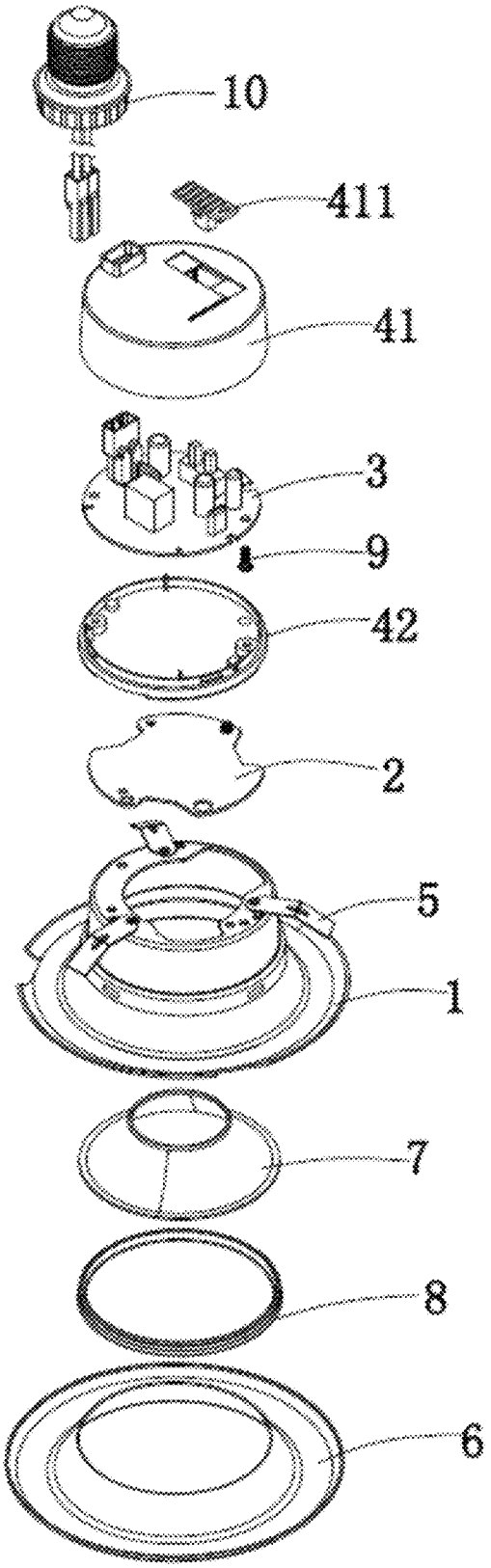
FIG. 2 is an exploded diagram of the embodiment in FIG. 1.
Figure 5:
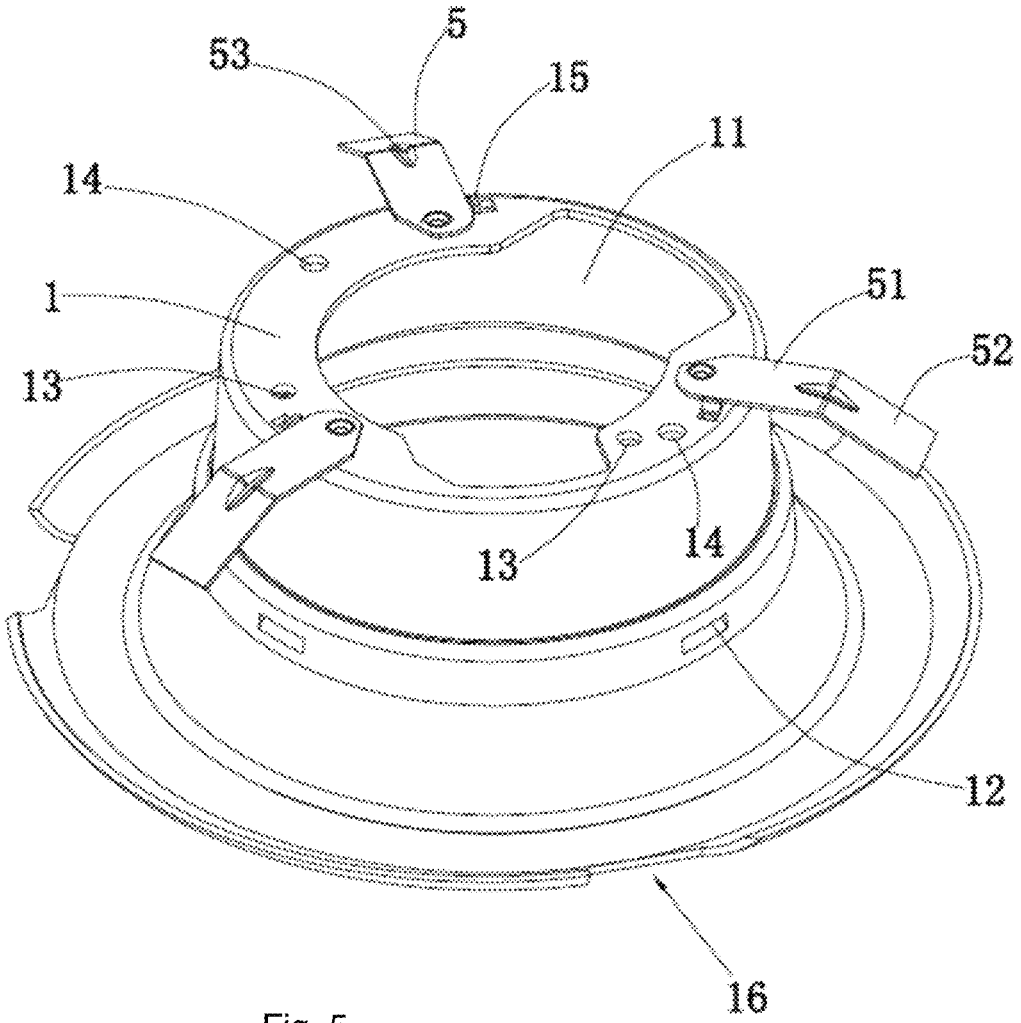
FIG. 5 is another component example.

Please refer to FIG. 1, FIG. 2 and FIG. 5. A downlight apparatus includes a light body 1, a light source module 2, a driver module 3 and driver box 4.

Among them, the driver box 4 is disposed on the light body 1. The light source module 2 is disposed between the light body 1 and the driver box 4. The driver module 3 is disposed within the driver box 4. An end of the driver box 4 near the light body 1 is disposed with at least two spacing groove 421. There are elastic sheet 5 rotatable and disposed to the light body 1 with a protrusion part outside the light body 1. The spacing groove 421 provides space for the damped rotation of each elastic sheet 5.

Among them, the driver module 3 is used to control the turn-on and turn-off of the light source module 2, the color temperature and the luminance level . . . etc. The light source module 2 uses the light body 1 for heat dissipation. The spacing groove 421 provides space for the elastic sheet 5 to rotate. The driver box 4 covers the light source module 2 that is on the light body 1. This protects the light source module 2 and the driver module 3.

In detail, the corresponding spacing groove 421 of the light body 1 is also disposed with the stop block 15 to prevent the elastic sheet 5 from constant rotation on the same side. When the elastic sheet 5 rotates to the stop block 15, the extended line of the elastic sheet 5 goes through the center line of the light body 1. When the elastic sheet 5 engages the stop block 15, the part of the elastic sheet 5 that is outside of the external surface of the light body 1 is the longest. In other words, when the elastic sheet 5 engages the stop block 15, the external diameter composed of multiple elastic sheet 5 reaches maximum and the external diameter is larger than the inner diameter of the installation cavity disposed on the ceilings.

When installing the downlight apparatus into the installation cavity of the ceiling, the elastic sheet 5 may be moved to the stop block 15 first, then insert the downlight apparatus directly into the installation cavity. The deformation of the elastic sheet 5 engages with the inner surface of the installation cavity. The quick installation of the downlight apparatus is then complete. When the downlight apparatus needs to be detached, rotates the downlight apparatus horizontally by using the friction between the end portion of the elastic sheet 5 and the inner surface to rotate the elastic sheet 5, the elastic sheet 5 is rotated with a direction away from the stop block 15 and gradually leaving the inner wall of the installation cavity. This simplifies the detachment of the downlight apparatus and enhances the convenience.

The embodiment provides a new kind of downlight apparatus. Through the elastic sheet 5 and the symmetrical rotation of the light body 1, the quick installment of the downlight apparatus and detachment may be achieved. This gives the downlight apparatus its user friendly, easy installment and detachable advantages.

In an embodiment, the downlight includes an installation box. The installation box is fixed on the ceiling and contains installation cavity. Among them, the inner diameter of the installation box is smaller than the maximum external diameter composed of multiple elastic sheet 5. This may secure the installation of the downlight apparatus within the installation box. When the downlight apparatus is installed within the installation box, the elastic sheet 5 may rotate using friction between itself and the inner surface of the installation box. Therefore, the maximum external diameter is smaller than the inner diameter of the installation box. That is how the downlight apparatus may be detached from the installation box.

Please refer to FIG. 1, when two elastic sheet 5 is disposed, the two elastic sheet 5 is disposed symmetrically. When three, four, or five elastic sheet 5 is disposed, the elastic sheet 5 will be disposed with even distance along axial direction on the light body 1. The amount of elastic sheet 5 may increase according to the overall weight of the downlight apparatus. In this embodiment, three elastic sheet 5 is disposed. By using triangle theory, the downlight apparatus may be installed securely, at the same time, saving material and lowering cost.

In an embodiment as indicated in FIG. 1 and FIG. 2, the downlight apparatus includes a lamp holder module 10. One end of the lamp holder module 10 is electrically connected to the driver module 3. The other end of the lamp holder module 10 is connected with outer power source. This provides power for the downlight apparatus.

Figure 3:
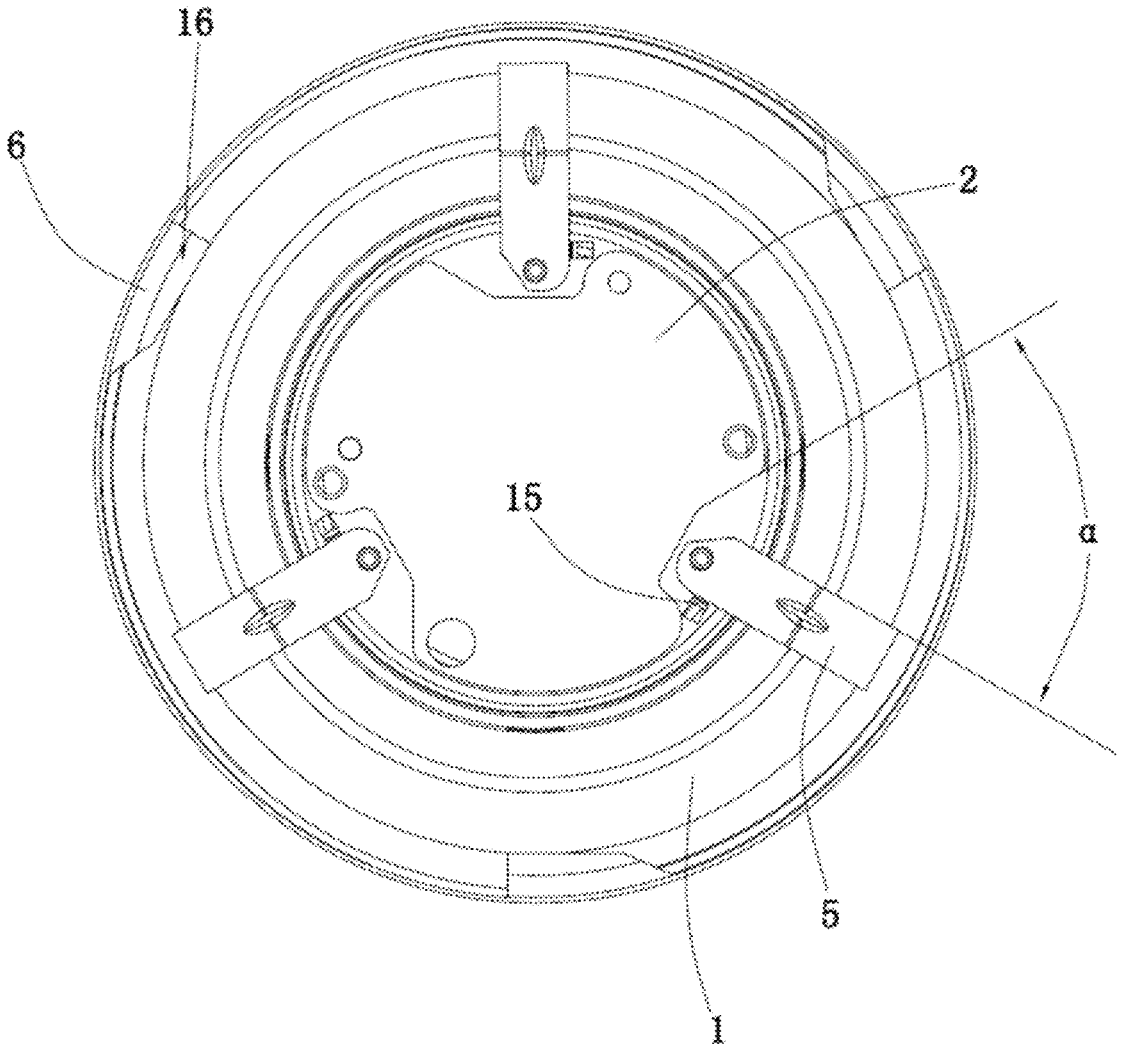
FIG. 3 is a top view of a rotation structure example.

As in FIG. 3, in an embodiment, the rotation angle of the elastic sheet 5 $\alpha$ is 0°~60°. The corresponding stop block 15 of the elastic sheet 5 has the rotation angle also 0°~60°. When the elastic sheet 5 engages stop block 15, the angle is 0°. Preferably, $\alpha$ is 60°. The rotating angle of the elastic sheet 5 may therefore reach its maximum, making it easier to leave space between the elastic sheet 5 and the inner surface of the installation cavity.

Figure 4:
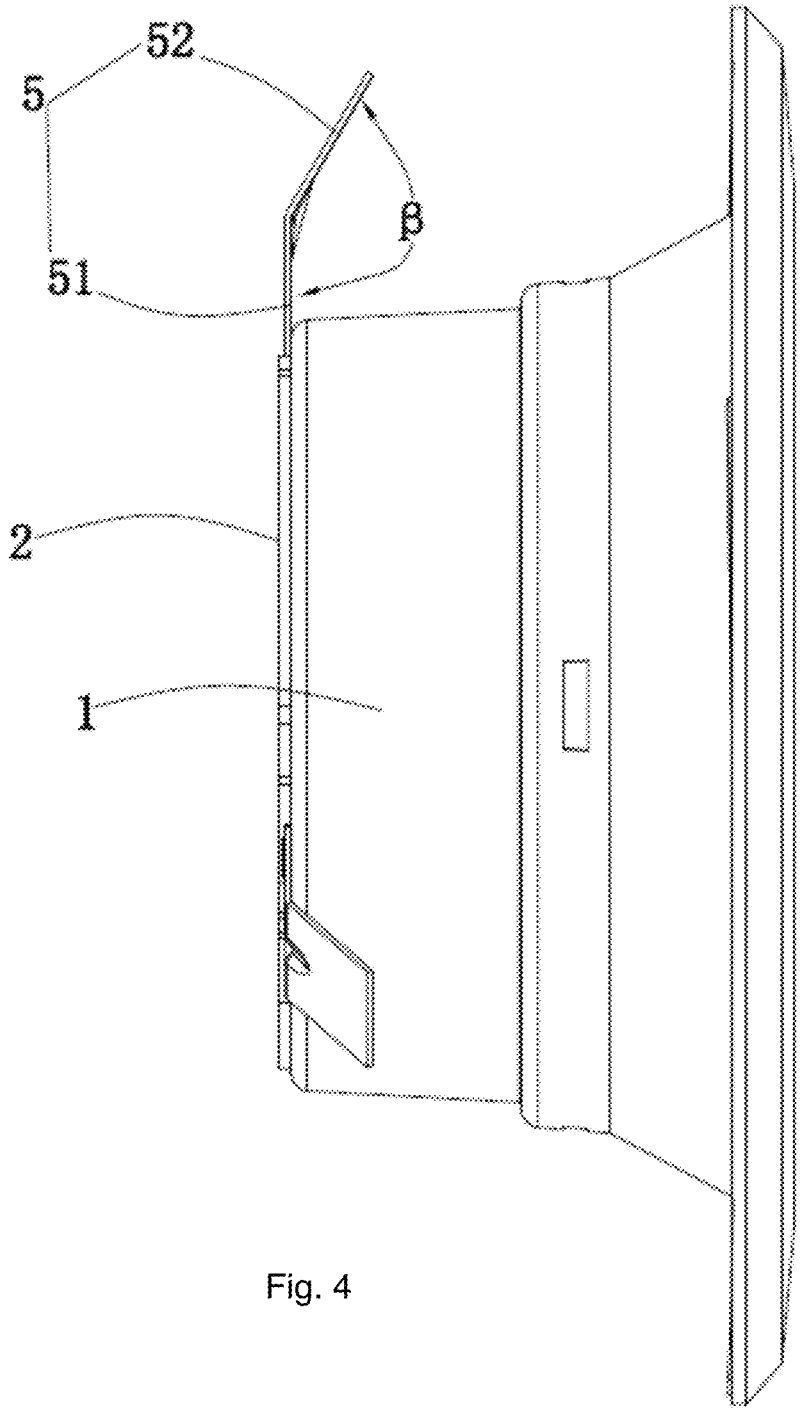
FIG. 4 is a component example.

As in FIG. 4 and FIG. 5, in an embodiment, the elastic sheet 5 holds a V-shaped plate like structure. The elastic sheet 5 includes a horizontal portion 51, and a tilt portion 52 extended from one end of the horizontal portion 51. The rotating other end of horizontal portion 51 is disposed on the light body 1. Among them, the horizontal portion 51 and the angle $\beta$ the tilt portion 52 is 95°~180°. When the elastic sheet 5 is disposed in the shape of V, the tilt portion 52 contains orientation and rebound function. Therefore, when the elastic sheet 5 engages stop block 15, the downlight apparatus may be directly inserted into the installation cavity of the ceiling, making it easier for installment. Preferably, angle $\beta$ is 150° and is in one-piece with the elastic sheet 5. In the embodiment, the elastic sheet is made from steel.

As in FIG. 4 and FIG. 5, in an embodiment, the horizontal portion 51 and the connecting point of the tilt portion 52 that is away from the angle does not have a pressed concave 53. The pressed concave 53 strengthens the structure near the angles. The pressed concave 53 enhances the tilt portion 52 and the anti-deformation of the horizontal portion 51. This enhances the weight capacity of the elastic sheet 5, prevents the out-flip of the corresponding horizontal portion 51 of the tilt portion 52 and the easy fall out of the downlight apparatus.

As in FIG. 4 and FIG. 5, in an embodiment, the length ratio of the horizontal portion 51 and the tilt portion 52 is 0.5~2. Preferably, the length ratio for the horizontal portion 51 and the tilt portion 52 is 1~1.5. Within this length range, when the length ratio between the horizontal portion 51 and the tilt portion 52 is smaller, the weight capacity of the elastic sheet 5 is stronger. Installment security may also be improved.

As in FIG. 5, in an embodiment, the elastic sheet 5 is rotationally disposed on the light body 1 through rivet connection. With rivet connection, the elastic sheet 5 may damp rotate correspondingly with the light body 1. With no outer pressure, it may maintain stillness and assure the installment security of the downlight apparatus. Of course, the elastic sheet 5 may also be rotationally disposed on the light body 1 with bolts.

Figure 10:
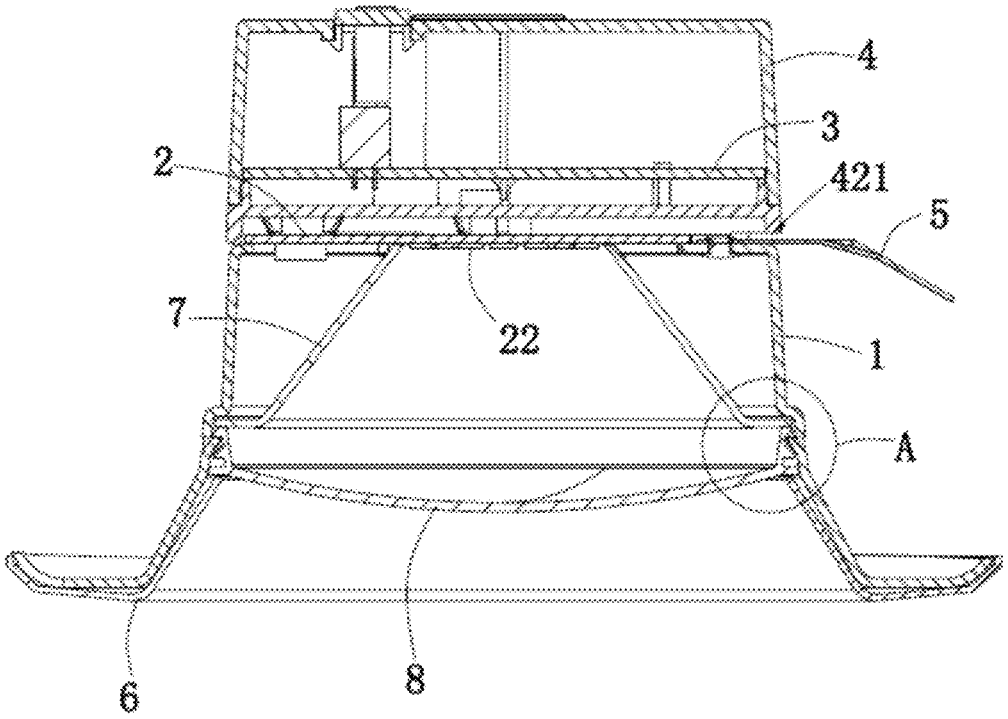
FIG. 10 is a cross section view of a downlight apparatus example.

As in FIG. 2 and FIG. 10, in an embodiment, the light body 1 is trumpet shape. The light body 1 does not have a reflector 7 within, and its light output opening does not have a light passing cover 8. Among them, the reflector 7 is also trumpet shape. The reflector 7 is used to reflect the light of the light source module 2 into the light output opening and out of the light passing cover 8. This enhances light intensity and utilization.

Figure 11:
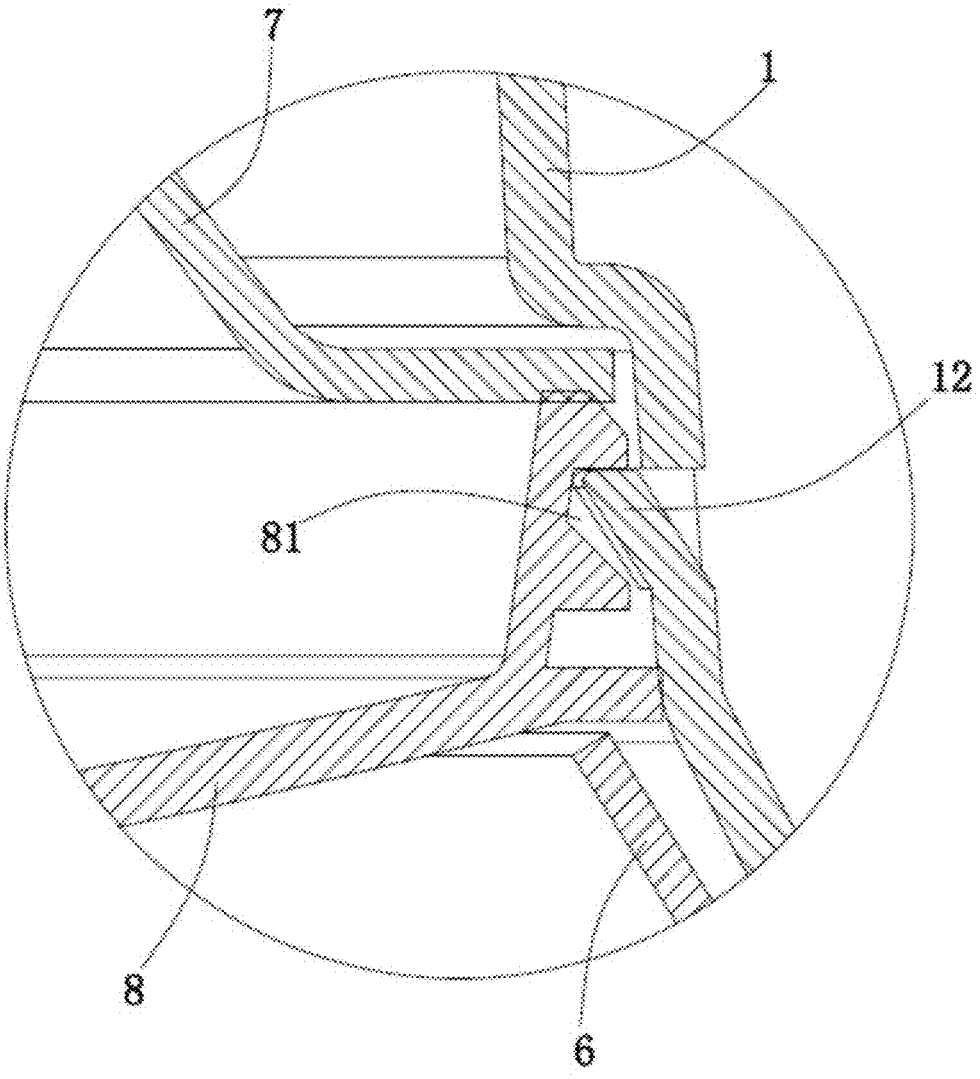
FIG. 11 shows an enlarged view of a portion in an example.

As in FIG. 10 and FIG. 11, in an embodiment, the light passing cover 8 is disposed on the light body 1 through buckle connection. In detail, the side surface of the light body 1 is disposed with multiple radial direction inwardly protruding circumference located protruding block 12. The circular groove 81 is disposed on the exterior side wall of the light passing cover 8. Each protruding block 12 is stuck within the circular groove 81 in order to fix the light passing cover 8 within the light body 1. Among them, the reflector 7 engages within the light body 1 through the light passing cover 8. In detail, one end of the reflector 7 engages on the light source module 2, and the other end engages on the light passing cover 8. This gives the reflector 7 the advantage of easy installment. The light passing cover 8 may be made from glass or plastic with glossy or matte surface. In other embodiments, the light passing cover 8 is fixed on the light body 1 through gluing, buckle, or screw groove.

In an embodiment, the light body 1 is made with metal material. In detail, aluminum, copper, or iron materials. In other embodiments, the light body 1 is made with plastic. In detail, PA (Polyamide), PBT (polybutylene terephthalate), PC (Polycarbonate), PS (Polystyrene) or ABS (acrylonitrile-butadiene-styrene copolymer) materials.

As in FIG. 5, FIG. 10, and FIG. 11, the detachable end of the light body 1 that is away from the driver box 4 is without the decoration surface rim 6. In detail, the opening 16 is disposed on the light body 1. The hook 422 is disposed on the decoration surface rim 6. Insert the hook 422 through the opening 16 then rotate the decoration surface rim 6 or the light body 1. The decoration surface rim 6 is installed through hooking the hook 422 with the light body 1. This gives it the advantage of easy installment.

In other embodiments, the decoration surface rim 6 may be glued like double-side tapping onto the light body 1, or with screw groove. In an embodiment, the hook is L shaped. An inserting groove is between the hook and the decoration surface rim 6. The light body 1 is inserted through the opening 16 and within the inserting groove. This secures fixed assembly.

In an embodiment, the decoration surface rim 6 is made with metal. In detail, as in aluminum, iron, copper, or other alloy materials. In other embodiments, the decoration surface rim 6 is made with plastic. In detail, A (Polyamide), PBT (polybutylene terephthalate), PC (Polycarbonate), PS (Polystyrene) or ABS (acrylonitrile-butadiene-styrene copolymer) materials. In an embodiment, the surface color of the decoration surface rim 6 may be chosen according to the set, like white, nickel, brown . . . etc. The design of the decoration surface rim 6 is convenient for downlight apparatus to fit into different sets. This enhances the variety of the appearance of the downlight apparatus.

Figure 6:
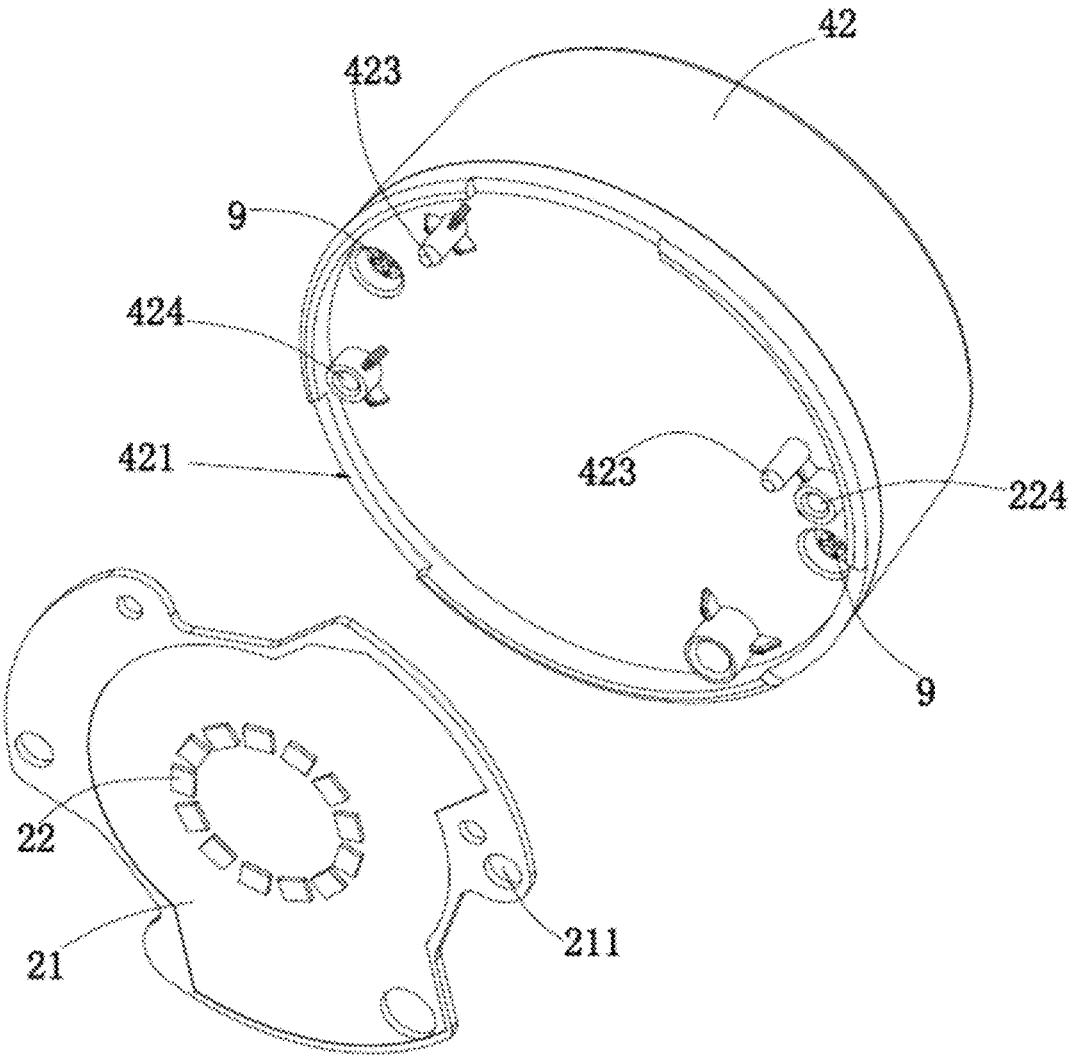
FIG. 6 shows a light source relation with a driver box.

As in FIG. 6, in an embodiment, the alight source module 2 includes a substrate plate 21 and a LED chip 22. The substrate plate 21 is aluminum. Multiple LED chips 22 is disposed and distributed in circumference. One end of the reflector 7 engages on the substrate plate 21 and encircles the LED chips 22. In an embodiment, usable LED chips 22 models are 2835, 3030, 5050, 5630, or one or multiple kinds of 3014 LED chips. In an embodiment, the LED chips 22 uses 2 times the speed for installment and applies mixed models and connections. Therefore, the LED chips 22 may be singly controlled in order to show different color temperature and luminance levels of lighting.

In an embodiment, as in FIG. 1, FIG. 5, and FIG. 6, the driver box 4 includes a detachable top cover 41 and a bottom cover 42.

In detail, as in FIG. 5 and FIG. 6, there are multiple screw holes on the light body 1. There are multiple through holes 211 on the substrate plate 21. There are multiple screw groove columns 424 on the bottom of the bottom cover 42. Among them, the fastener 9 goes through the screw hole like a screw. The through hole 221 connects with the screw groove of the screw groove column 424 in order to fix the light source module 2 between the light body 1 and the driver box 4. This ties the light body 1 together with the driver box 4, making it convenient for assembling. In detail, there are multiple positioning holes 13 on the light body 1. There are multiple through holes 211 on the substrate plate 21. There are multiple positioning columns 423 on the bottom of the bottom cover 42. By disposing the positioning column 423 and the positioning hole 13, it makes it more convenient for the light body 1 and the assembly of the driver box 4. This also enhances the efficiency for installment.

In an embodiment, as in FIG. 3, there are multiple concave portions on the substrate plate 21. This is convenient for the rotation of the elastic sheet 5. Among them, the substrate plate 21 is thicker than the elastic sheet 5.

As in FIG. 3 and FIG. 5, in an embodiment, one end of the light body 1 that is near the driver box 4 is disposed with the opening hole 11. The light source module 2 is disposed on the external surface of the light body 1. Among them, the LED chips 22 goes through the opening hole 11 and shines into the light body 1. This may reduce the weight the light body 1 and production cost, and also make it easier for the installment of the light source module 2. There are line passing holes on both the substrate plate 21 and the driver box 4. This is to electrically connect the driver module 3 and the light source module 2.

Figure 7:
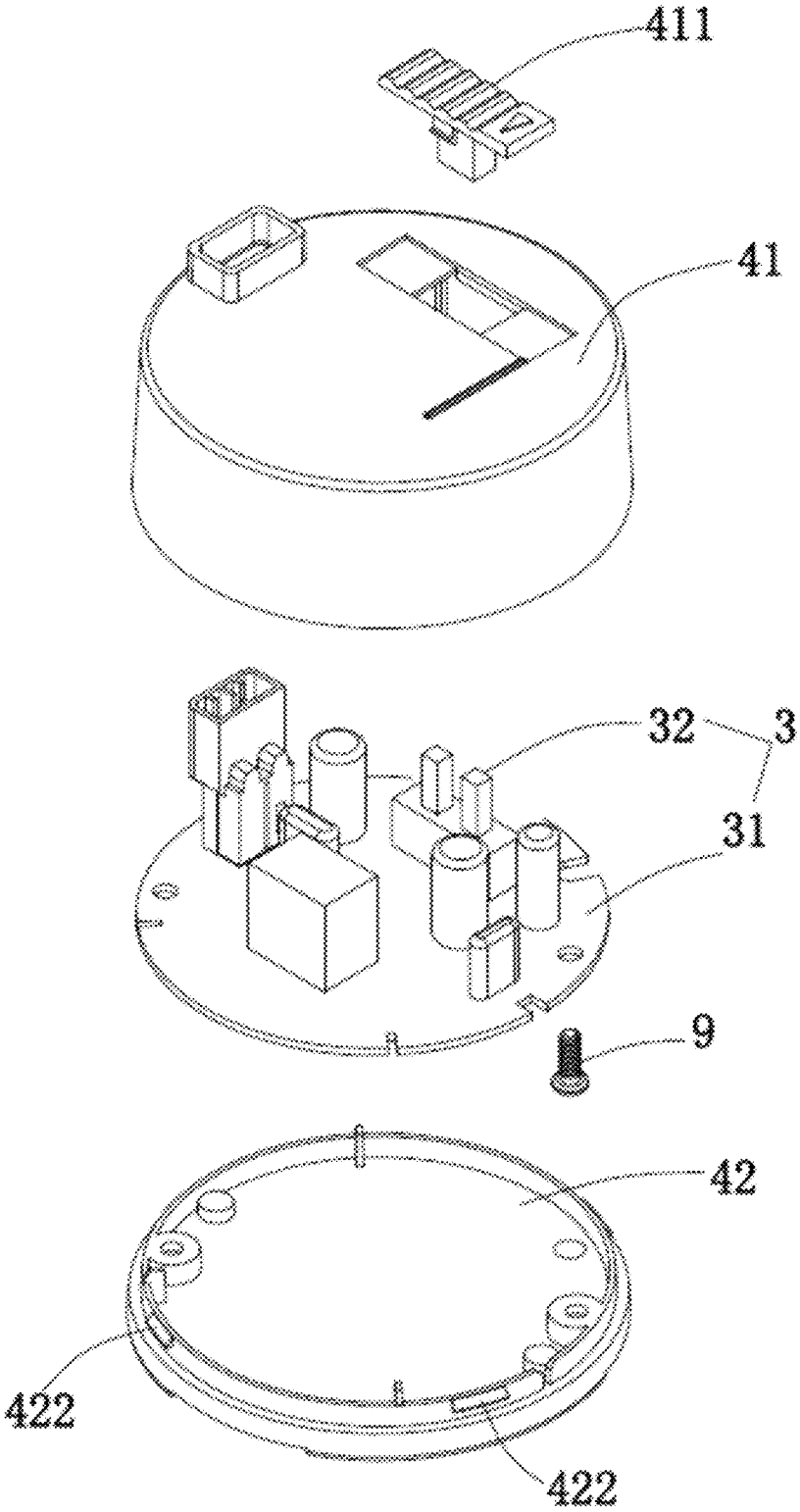
FIG. 7 shows components in an example.
Figure 8:
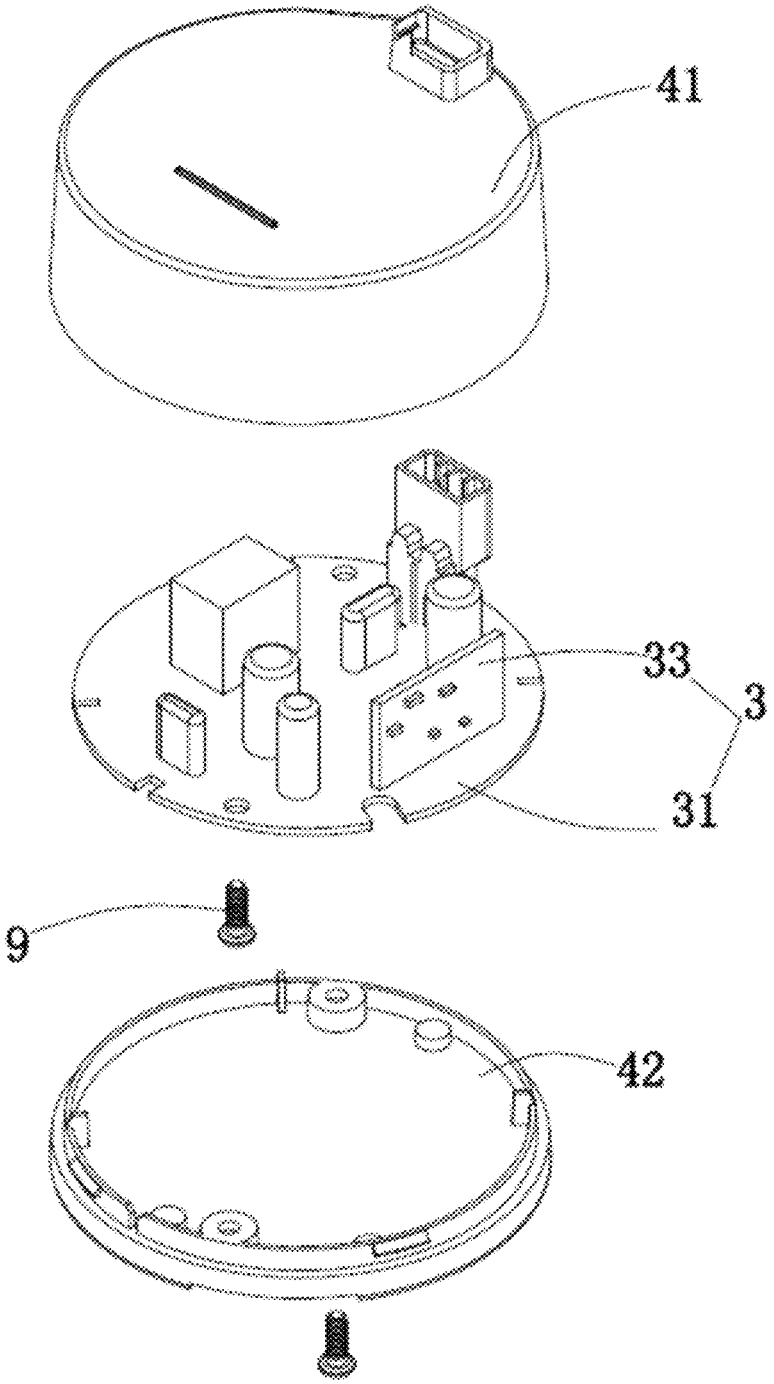
FIG. 8 shows another view of an example.

As in FIG. 6, FIG. 7, and FIG. 8, in an embodiment, the driver module 3 includes the driver circuit board 31 and the manual switch 32 of the driver circuit board 31 that is used to adjust color temperature. In detail, an installment hole is disposed on the top cover 41. The on-off switch 411 of the manual switch 32 is disposed thorough the installment hole. In other embodiments, the manual switch 32 may be substitute by the potential sider. Among them, the manual switch or the potential sider is used to adjust the color temperature of the LED chips 22 of the light source module 2, light intensity, and turn-on and off. This is to present different color temperature and light intensity of the light source module 2.

In an embodiment, there are multiple installment columns 413 within the top cover 41. The driver circuit board 31 is fixed within the driver box 4 through the fastener 9 like screws. Among them, the screw of the of the bottom cover 42 goes through the outer surface and connects with the screw groove of the installment column 413 that is within the top cover 41. If the top cover 41 is made with plastic, grub screw may be used.

Figure 9:
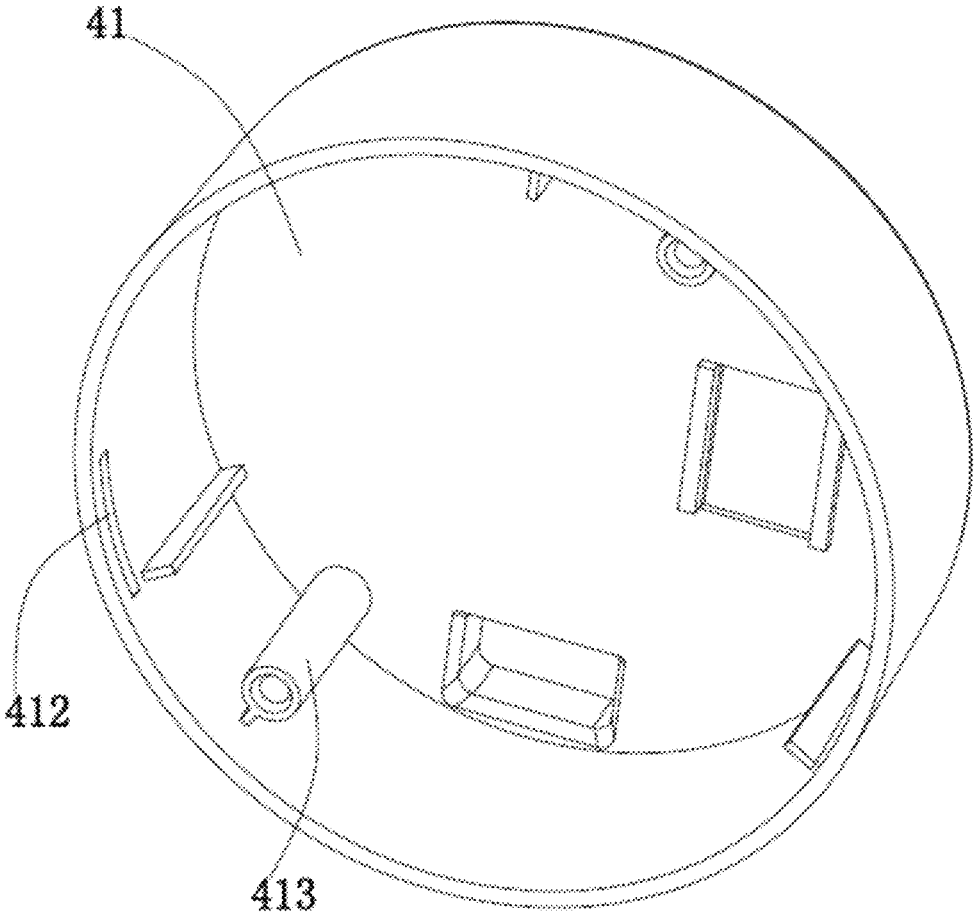
FIG. 9 shows a component in a downlight apparatus.

In an embodiment, as in FIG. 8 and FIG. 9, the top cover 41 and the bottom cover 42 is secured through buckle connection. In detail, there are multiple hooks 422 on the bottom cover 42. There are hook grooves 412 on the inner side wall of the top cover 41 for hook 422. Through using hook 422 and hook groove 412, this gives the top cover 41 and the bottom cover 42 the advantage of easy installment. At the same time, screws secure the installment.

As in FIG. 8, in an embodiment, the driver module 3 includes the driver circuit board 31 and the intelligent card 33 of the driver circuit board 31 that is used for adjusting color temperature. Among them, the intelligent card 33 is vertically disposed on the driver circuit board 31. The intelligent card 33 is disposed through welding to achieve the conduction of the photoelectric signal. The wireless module is disposed on the intelligent card 33. The wireless module includes an internal antenna and an external antenna. This is to control the different light and color adjustment of the LED chip 22, turn-on/off . . . etc. the wireless module is also used for transmitting information with outer receiving end. The outer receiving end equipment may be cellphones, computers, remotes, or on-off control pads . . . etc. Both uses APPs, Bluetooth, Wi-Fi . . . etc. to transmit information.

In an embodiment, the intelligent card 33 may take the form of squares, rectangles, circles, or other shapes. When using the intelligent card 33, an installment hole may be disposed on the top cover 41 to enhance the dustproof ability of the driver box 4.

The embodiment uses new versions of the downlight apparatus. Through rotationally disposing the elastic sheet 5, the downlight apparatus has the advantage of easy installment and detachment. With detachable decoration surface rim 6, the adjustment ability of the downlight apparatus is enhanced to meet the needs for different sets and obtains its appearance and coordination. Through the opening hole 11 of the light body 1, the light source module 2 is disposed on the external surface of the light body 1, making it easier for the installment of the light source module 2, reduces the weight of the downlight apparatus, lowers production cost, and increase market competitiveness. With the manual switch 32 of the driver module 3, the potential sider, or the intelligent card 33, the downlight apparatus may present different color temperature and light intensity, the versatility of the enhance lights, achieve multifunction, and increase market competitiveness.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A downlight apparatus, comprising:

a light source module with multiple LED modules;

a cup housing having a surface rim and cup body, the surface rim defining a light opening, the light opening being located at an opening horizontal plane, the surface rim covering an installation hole of an installation cavity, the multiple LED modules being disposed in a container space of the cup housing for emitting light out of the downlight apparatus from the light opening;

a rotation structure selectively defining a first exterior diameter and a second exterior diameter, the first exterior diameter being larger than the second exterior diameter and an installation diameter of the installation hole, the second exterior diameter being smaller than the installation diameter, the rotation structure being connected to the cup housing, wherein when the downlight apparatus is to be installed to the installation cavity, the rotation structure is adjusted to the second exterior diameter to put the downlight apparatus in the installation cavity from the installation hole, wherein there is a safety switch connecting to a driver, the driver supplying a driving current to the light source module, when the rotation structure is modified from the first exterior diameter to the second exterior diameter, the safety switch is triggered to cut the driving current to the light source module.

2. The downlight apparatus of claim 1, wherein the rotation structure comprises multiple rotating arms, arm ends of the multiple rotating arms defining the first exterior diameter and the second exterior diameter.

3. The downlight apparatus of claim 2, wherein the rotation structure has two rotating arms disposed in opposite sides of the downlight apparatus.

4. The downlight apparatus of claim 2, wherein the rotation structure has at least three rotating arms symmetrically arranged.

5. The downlight apparatus of claim 2, wherein the rotation arm has a rotation shaft fixed to the cup housing for the rotation arm to rotate for changing the rotation structure from the first exterior diameter to the second exterior diameter.

6. The downlight apparatus of claim 5, wherein there is a receiver groove for containing at least a portion of the rotating arm.

7. The downlight apparatus of claim 2, wherein the rotation structure further comprises elastic units for the rotating arms respectively for providing elastic forces to recover the rotation structure from the second exterior diameter to the first exterior diameter.

8. The downlight apparatus of claim 2, wherein the rotating arm has a curved end portion.

9. The downlight apparatus of claim 2, wherein the rotating arm has an end portion attached with a friction pad for increasing friction between the rotating arm and the installation cavity.

10. The downlight apparatus of claim 2, wherein there is a connecting structure for brining other rotating arms to rotate when one rotating arm is rotated.

11. The downlight apparatus of claim 1, wherein the rotating arm comprises metal units engaging the installation cavity.

12. The downlight apparatus of claim 11, wherein the rotating arm is an elongated metal sheet.

13. The downlight apparatus of claim 1, wherein the rotating arm dissipates heat of the light source via a heat conducting structure.

14. The downlight apparatus of claim 1, wherein the rotation structure has an elastic force to recover from deformation.

15. The downlight apparatus of claim 1, further comprising a driver box, wherein the rotation structure is disposed between the driver box and the cup housing.

16. The downlight apparatus of claim 15, wherein the driver box has a bottom cover, and the light source is mounted on the bottom cover.

17. The downlight apparatus of claim 16, wherein the bottom cover is connected to the cup housing together forming the container space.

18. The downlight apparatus of claim 15, wherein the driver box has a metal housing for carrying away heat of the light source module and a driver circuit disposed in the metal housing.

* * * * *